US006393659B1

(12) United States Patent
Gessler

(10) Patent No.: US 6,393,659 B1
(45) Date of Patent: May 28, 2002

(54) HANDLE

(75) Inventor: Markus Gessler, Tettnang (DE)

(73) Assignee: Winterhalter Gastronom GmbH, Meckenbeuren (DE)

( * ) Notice: Subject to any disclaimer, the term of this patent is extended or adjusted under 35 U.S.C. 154(b) by 0 days.

(21) Appl. No.: 09/611,262

(22) Filed: Jul. 6, 2000

(30) Foreign Application Priority Data

Jul. 9, 1999 (DE) ..... 199 31 855

(51) Int. Cl.[7] ..... A47J 45/00; E05B 1/00; E05B 5/00

(52) U.S. Cl. ..... 16/110.1; 16/430; 16/443

(58) Field of Search ..... 16/110.1, 430, 16/425, 440, 443; 134/57 DL, 58 DL, 200; 312/229, 272, 312; 206/203, 510

(56) References Cited

U.S. PATENT DOCUMENTS 3,133,311 A * 5/1964 Riebsamen ..... 16/110.1
3,731,839 A * 5/1973 Long ..... 220/651
4,073,555 A * 2/1978 Noren ..... 312/229
4,093,327 A * 6/1978 Linger ..... 312/244
4,495,673 A * 1/1985 Khan ..... 16/232
4,811,997 A * 3/1989 Suyama et al. ..... 312/228
5,873,147 A * 2/1999 Hintz ..... 16/110.1

FOREIGN PATENT DOCUMENTS

| | | |
|---|---|---|
| FR | 2 530 136 | 1/1984 |
| GB | 1127294 | 4/1966 |

* cited by examiner

*Primary Examiner*—Chuck Y. Mah
(74) *Attorney, Agent, or Firm*—Morgan, Lewis & Bockius LLP

(57) ABSTRACT

A handle for a raisable covering means, such as a door of a dishwasher. The aim of the claimed invention is to develop a handle which is adapted for optimum gripping by either or both hands, it being possible for the operator to be in different positions.

11 Claims, 4 Drawing Sheets

HANDLE

BACKGROUND OF THE INVENTION

The invention relates to a handle for a raisable covering means such as a door of a dishwasher.

The claimed handle serves to move upward or downward a door of a dishwasher, which covers the dishes during the dishwashing operation. The prior art discloses, for example, a bracket-like handle which is approximately of the same width as the front side of the door. This handle is of U-shaped or trough-like configuration and has its central part running parallel to the front side of the door.

In practice, dishwashers are used in so-called push-through operation. Push-through operation is intended to mean operation during which the baskets with the dirty dishes are fed to the machine from one side and the baskets with the cleaned dishes are removed from the other side. There are push-through machines which are operated in a line, with the result that the dishes are fed to the machine on the left-hand side and are removed from the machine on the right-hand side. In machines which are used in this way, the door of the machine can be operated from the front side. Also known are push-through machines for corner installation, in the case of which the dishes, for example, are fed from the right and removed to the front. These machines merely allow the door to be operated from an oblique position laterally in front of the machine.

However, the operation of the doors of the dishwashers installed in a line or across a corner does not take place totally satisfactorily. It is extremely important to achieve the situation where the operator is subjected to minimal loading, since the door has to be raised and lowered over 500 times during one shift.

The object of the claimed invention is to develop a handle which is suitable for optimum gripping by the left and/or right hand, it being possible for the individual actuating the door to be in different positions relative to the door.

SUMMARY OF THE INVENTION

The handle according to the claimed invention is fastened in a horizontal position on two adjacent side parts of the door, the handle having at least three gripping points which are shaped such that the position of the hand actuating the handle is aligned substanially along an axis axial to the handle. This makes it possible for left-handers and right-handers to operate the door both from a front position and from a corner position.

A preferred embodiment of the claimed invention provides that the outwardly directed inclination of the handle center axis corresponds to half the opening angle between the forearms, half the opening angle corresponding to the angle of the handle center axis in relation to the front side of the door. This measure ensures that the handle can be gripped by both hands of an individual standing in front of the machine, such that the position of the hand in relation to the forearm remains rectilinear, i.e. in the natural position, during gripping and during movement.

In an alternate embodiment the handle has a longer, first leg, which is aligned with the front side, and a shorter second leg, which is aligned with the side surface, said legs being connected via an essentially circular segment. This embodiment forms a maximum utilizable handle region, with minimal handle size, in the front region and in the region obliquely in front of the machine or door.

According to another alternate embodiment, the handle is suitable for fastening on the left and right. This mirrorsymmetrical embodiment of the handle, which is suitable for being positioned on the left and right of the door, simplifies the installation since incorrect installation is prevented.

Another alternate embodiment of the claimed invention has a plastic-coated metal core. This embodiment combines optimum gripping properties, slipping is virtually ruled out, with optimum stability.

The invention provides that the claimed handle serves for stabilizing the side walls of the dishwasher. By virtue of the handle being used as a stabilizing element, the design of the door may be more lightweight and thus more cost-effective, since the handle contributes significantly to the stability of the structural part.

BRIEF DESCRIPTION OF THE DRAWINGS

Further details of the claimed invention are described, with reference to schematically illustrated preferred embodiments, in the drawing, in which:

DETAILED DESCRIPTION OF THE PREFERRED EMBODIMENTS

Figure 1:
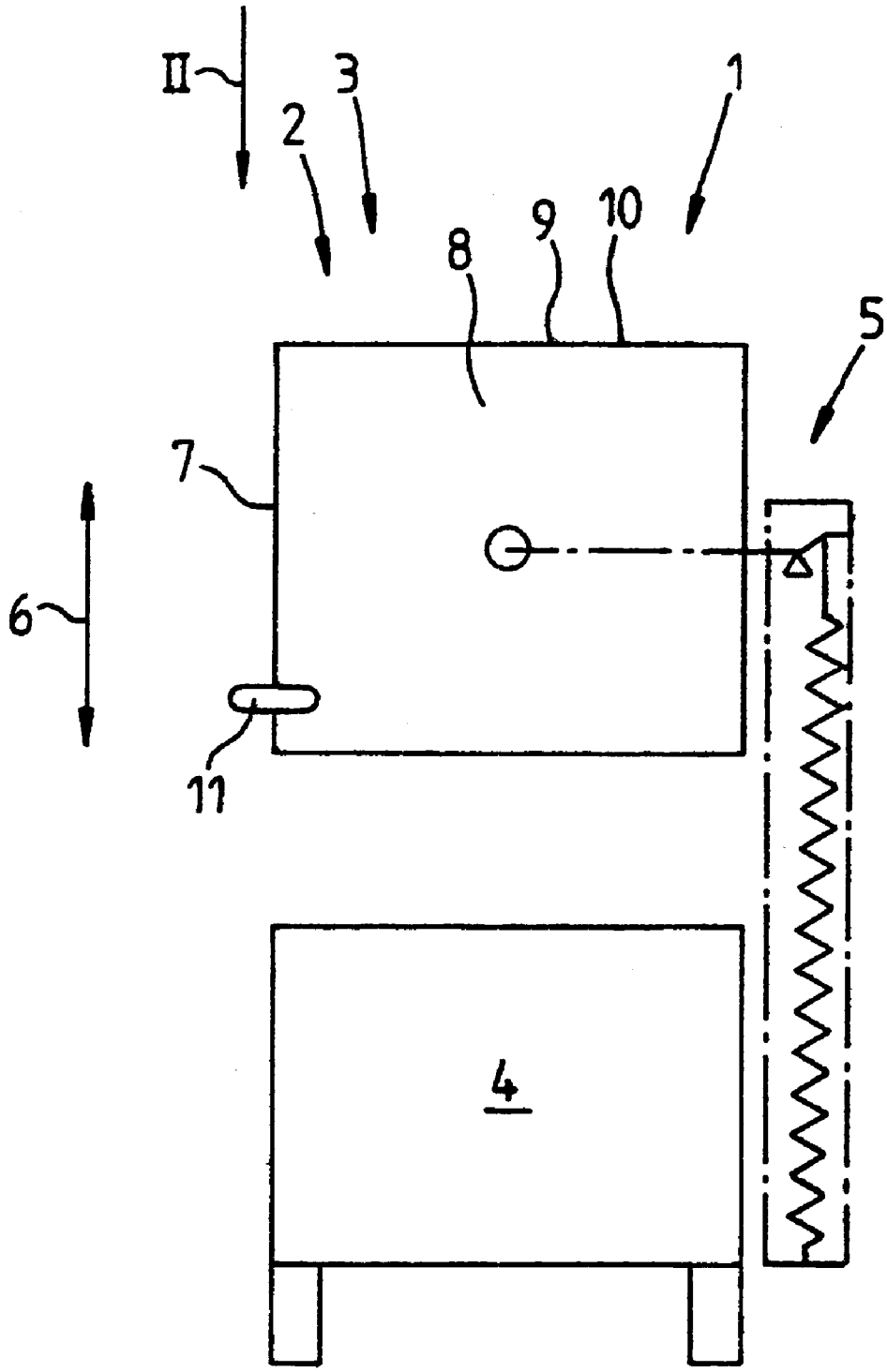
FIG. 1 shows a schematic side view of a dishwasher.

FIG. 1 shows a schematic side view of a dishwasher 1 with a door 3 designed as a covering means 2 and with a basic body 4. The door 3 is fitted on a lifting mechanism 5 such that it can be displaced upward and downward in the direction of the double arrow 6. The door 3 has a front side 7, a right-hand side surface 8, a left-hand side surface 9 and a roof side 10. A first handle 11 is fastened on the front side 7 and on the right-hand side surface 8, and a second handle 12 (FIG. 4) is fastened on the front side 7 and the left-hand side surface.

Figure 2:
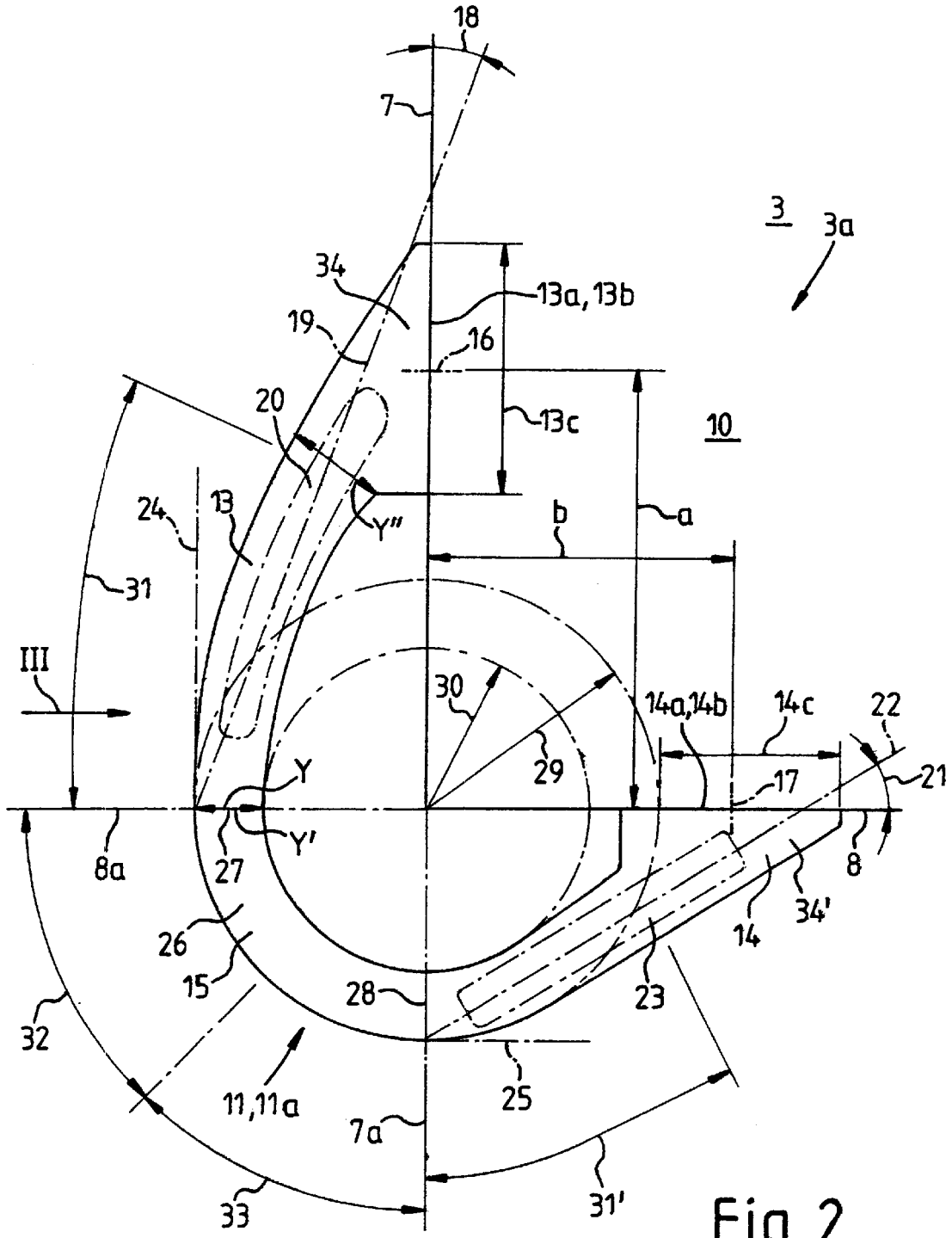
FIG. 2 shows a plan view of the corner region with right-hand handle of the door of the dishwasher.

FIG. 2 shows a plan view of a corner region 20 of the door 3 from the direction of the arrow II in FIG. 1. The plan view of the corner region 20 shows the first handle 11, the front side 7, the right-hand side surface 8 and the roof side 10. It is also possible to see an extension 7*a* of the front side 7 and an extension 8*a* of the right-hand side surface 8. The extensions 7*a* and 8*a* divide the handle 11 into three regions. These are a leg 13, which is aligned with the front side 7, a further leg 14, which is aligned with the right-hand side surface 8, and a circular segment 15, which is located between the extensions 7*a*, 8*a*. The legs 13, 14 each have a large-surface-area connection flange 13*a*, 14*a* configured as an ellipse 13*b*, 14*b*. The ellipse 13*b* has a major ellipse axis 13*c* with a length of approximately 8 cm and a minor ellipse axis 13*d* (FIG. 3) with a length of approximately 5 cm. The ellipse 14*b* has a major ellipse axis 14*c* with a length of approximately 7 cm and a minor ellipse axis (not illustrated) with a length of approximately 5 cm. The two legs 13, 14 are connected to the side surfaces 7, 8 by connecting means 16, 17. As a result of the fastening of the handle 11 on the side surfaces 7, 8 and the large-surface-area bearing of the connection flanges 13*a*, 14*a*, the handle 11 acts on the door 3 in the manner of a stiffening angle 11*a*. The distance a between the fastening means 16, arranged centrally in the connection flange 13*a*, and the side surface 8 is approximately 14 cm when measured parallel to the front surface 7. The distance b between the fastening means 17, arranged centrally in the connection flange 14*a*, and the front surface 7 is approximately 10 cm when measured parallel to the side surface 8.

The leg 13 runs from the front side 7 to the extension 8*a* at an angle 18 in relation to the front side 7, said angle being determined by a handle center axis 19 which runs approximately in a central region 20 (region bounded by chain-dotted lines) of the leg 13. The angle 18 is in a range from 10° to 30°. The leg 14 runs from the side surface 8 to the extension 7*a* at an angle 21 in relation to the side surface 8, said angle being determined by a handle center axis 22 which runs approximately in a central region 23 (region bounded by chain-dotted lines) of the leg 14. The angle 21 is in a range from 20° to 40°.

It can also be seen in FIG. 2 that the leg 13 merges along a tangent 24 into the circular segment 15 of the handle 11. The leg 14 also has such a transition along a tangent 25. The circular segment 15 is designed as a quarter-circle segment 26 which merges into the leg 13, 14 at section planes 27, 28. The quarter-circle segment 26 is determined essentially by the external radius 29 and the internal radius 30. In the claimed invention, the external radius 29 is approximately 7 cm and the internal radius 30 is approximately 5 cm. When viewed in three dimensions, the quarter-circle segment 26 constitutes a quarter-circle segment of a torus of approximately elliptical cross section.

The handle 11 illustrated in FIG. 2 also has four gripping regions 31, 31', 32, 33, these being formed essentially in the region of the leg 13, in the region of the circular segment 15 and in the region of the leg 14. In the claimed invention, the first gripping region 31 is located in the region of the leg 13, between a flange region 34 and the transition to the circular segment 15. The second and the third gripping regions 32, 33 are located in the region of the circular segment 15. The fourth gripping region 31' is located in the region of the leg 14, between a flange region 34' and the transition to the circular segment 15.

According an alternate embodiment claimed invention which is not shown, the gripping regions 31, 31', 32, 33 overlap partially, this being easily possible since the handle 11 is only gripped by one hand. This means that even individuals with very large hands can still grip the handle 11 in a comfortable and ergonomically correct manner.

In the installed position of the handle 11 which is shown in FIG. 2, the first and the third gripping regions 31, 33 are provided for gripping by the right hand. The second gripping region 32 is suitable for gripping by the left hand. The fourth gripping region 31' is provided for gripping by the right or left hand when the individual doing the gripping is standing, for example, alongside the dishwasher 1.

Figure 3:
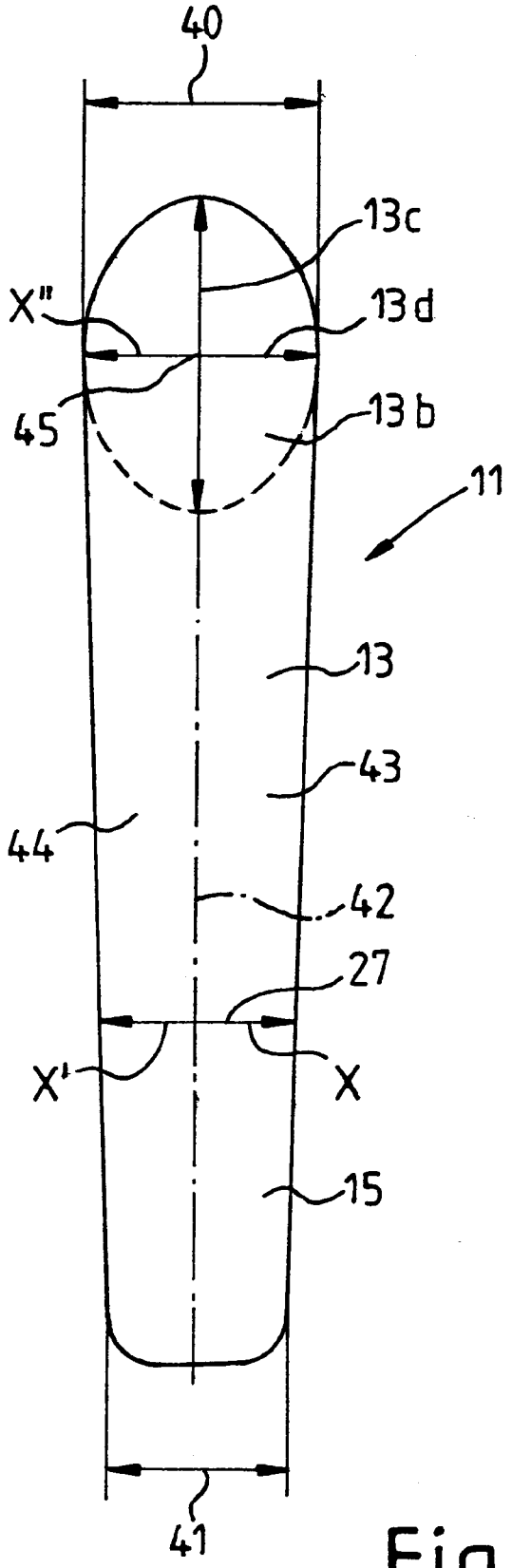
FIG. 3 shows a view of the handle in the direction of the arrow III in FIG. 2.

FIG. 3 shows a view of the handle 11 in the direction of the arrow III depicted in FIG. 2. It can be seen in this view that a height 40 of the handle 11 in the flange region 34 is greater than a height 41 in the region of the circular segment 15. The height 41 is approximately 20% smaller than the height 40. In the direction of the ellipse 14*b* of the leg 14, the height of the handle 11 increases again to the value of the height 40 (which cannot be seen from FIG. 3). At the section plane 27, the handle 11 has an approximately elliptical cross section, the major ellipse axis x having a length x' of approximately 4 cm, which is smaller than the height 40 and greater than the height 41 of the handle 11. The minor ellipse axis y (FIG. 2) of the section plane 27 has a length y' of approximately 2 cm. From the region of the circular segment 15 to the flange regions 34, 34', the minor ellipse axis y increases to a more pronounced extent than the major ellipse axis x. The minor ellipse axis y increases to a length y" of approximately 3 cm and the major ellipse axis x increases to a length x" of approximately 5 cm. On account of the abovementioned peripheral dimensions, the periphery of the handle 11 at the gripping regions 31, 31', 32, 33, has an optimum grip-round length.

FIG. 3 also shows a center plane 42 of the handle 11. This center plane 42 divides the handle 11 into a top half 43 and a bottom half 44, which are symmetrical in relation to one another. For this reason, it is also possible for the handle 11 to be used as a handle 12, by being rotated through 180° about an axis 45 running in the plane of the drawing, without this being disadvantageous ergonomically.

Figure 4:
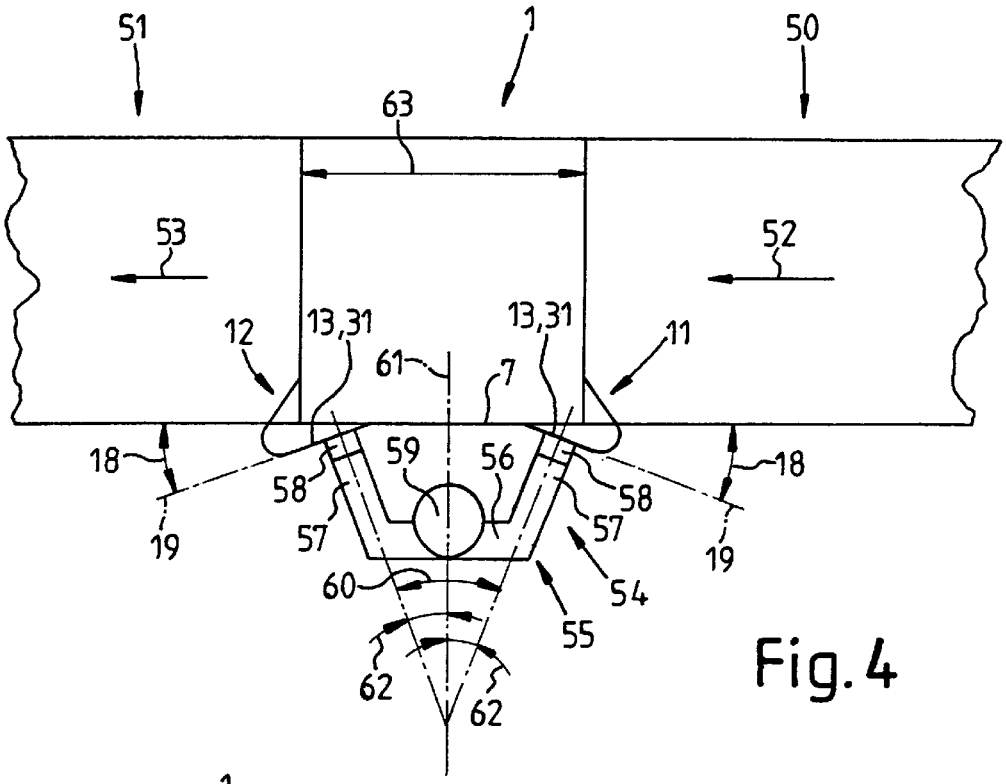
FIG. 4 shows a schematic view from above of a dishwasher installed in linear form, an individual also being included in the illustration.

FIG. 4 shows a schematic view of the dishwasher 1 installed in linear form. Transporting tables 50, 51 are located to the left and right alongside the dishwasher 1. From the transporting table 50, dishes (not illustrated) are pushed into the dishwasher 1 in the direction of an arrow 52. For this purpose, the door 3 of the dishwasher 1 is located in the open position (FIG. 1). The door 3 is then displaced downward into the closed position by a schematically illustrated individual 55 positioned in front 54 of the dishwasher. Following completion of the cleaning operation, the door 3 is displaced into the open position again by the individual 55, with the result that the dishes can be moved out onto the transporting table 51 in the direction of an arrow 53. It is then possible for the dishwasher 1 to be charged with dishes again.

The individual 55 illustrated in FIG. 4 has a body 56, forearms 57, hands 58 and a head 59. The forearms 57 open away from the body 56 at an opening angle 60. The individual forearm 57 with the hand 58 is at half an opening angle 62 in relation to an axis 61, which is perpendicular to the front side 7 of the dishwasher and divides the individual 55 symmetrically. The handles 11, 12 are illustrated schematically in FIG. 4. To simplify matters, it should be stated that the designations already introduced for the handle 11 also relate to the handle 12, since the handles 11, 12 are structural parts which are symmetrical in relation to one another. The schematically illustrated handles both have the leg 13 with the gripping region 31 and the center axis 19. The center axes 19 run at an angle 18 in relation to the front side 7. The angles 18 are such that they correspond in each case to half the opening angle 62. This ensures that the individual 55 can grip the gripping region 31 while the forearm 57 and hand 58 are in the ergonomically correct rectilinear position. The angles 18 and 62 are determined in dependence on a width 63 of the door 3. The dishwasher 1 installed in linear form is provided for the individual 55 to operate using both hands, this being beneficial for a locomotor apparatus (not illustrated). The fact that the individual 55 is positioned in front of the dishwasher, however, also allows single-handed operation.

Figure 5:
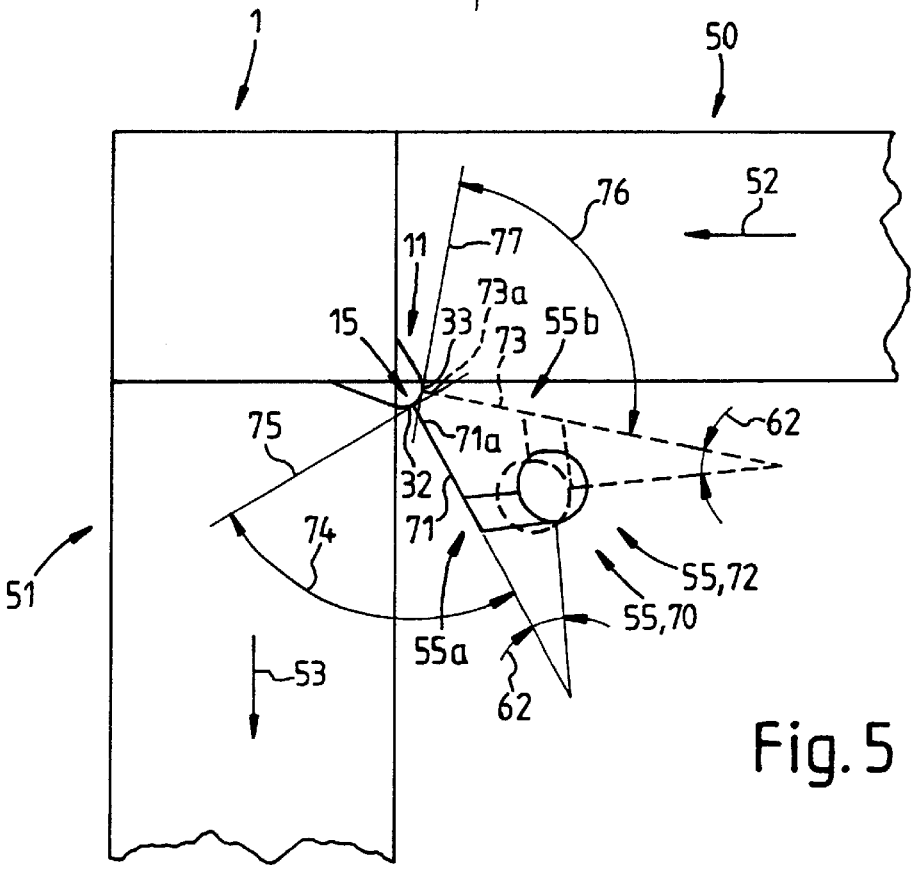
FIG. 5 shows a schematic view from above of a dishwasher installed across a corner, an individual also being included in the illustration.

FIG. 5 shows a schematic view of the dishwasher 1 installed across a corner. The transporting tables 50, 51 are located to the right and in front of the dishwasher 1. From the transporting table 50, dishes (not illustrated) are pushed into the dishwasher 1 in the direction of the arrow 52. For this purpose, the door 3 of the dishwasher 1 is located in the open position (FIG. 1). The door 3 is then displaced downward into the closed position by a schematically illustrated individual 55 standing in an oblique position laterally in front of the dishwasher 1. Following completion of the cleaning operation, the door 3 is displaced into the open position again by the individual 55 using one hand, with the result that the dishes can be moved out onto the transporting table 51 in the direction of the arrow 53. It is then possible for the dishwasher 1 to be charged with dishes again.

FIG. 5 illustrates two positions 55*a* (solid lines), 55*b* (dashed lines) for the individual 55 positioned obliquely laterally in front of the dishwasher 1, the position 55*a* schematically showing a left-hand half 70 of the individual 55 operating the handle 11 using the left forearm 71 or the left hand 71*a*. The position 55*b* shows the right-hand half 72 of the individual 55 operating the handle 11 using the right forearm 73 or the right hand 73*a*. It is also possible to see the circular segment 15 of the handle 11, said segment having the gripping regions 32, 33.

For gripping by the left hand 71*a*, the individual 55 illustrated by the left-hand half 70 selects the position 55*a* such that the forearm 71 and the hand 71*a* come to rest at a right angle 74 to a tangent 75 to the gripping region 32. In this position 55*a*, ergonomic gripping is ensured since the individual 55 holds the forearm 71 and the hand 71*a* at an ergonomically favorable opening angle 62.

For gripping by the right hand 73*a*, the individual 55 illustrated by the right-hand half 72 selects the position 55*b* such that the forearm 73 and the hand 73*a* come to rest at a right angle 76 to a tangent 77 to the gripping region 33. In this position 55*b*, ergonomic gripping is ensured since the individual 55 holds the forearm 73 and the hand 73*a* at an ergonomically favorable opening angle 62.

The claimed invention is not restricted to the embodiments which have been illustrated or described herein. It also covers the full scope defined by the language of the following claims and equivalents thereof.

What is claimed is:

1. A handle for a raisable door of a dishwasher, fastened in a horizontal position in a first corner region of a first surface and an adjacent second surface of the door, wherein the handle comprises:

a first leg having a first end angularly attached to the first surface of the door, the first leg having at least a first portion spaced from the first surface to permit fingers of a hand to fit between the first portion and the first surface when gripping the first leg; and a second leg having a second end angularly attached to the second surface of the door, the second leg having at least a second portion spaced from the second surface to permit the fingers of the hand to fit between the second portion and the second surface when gripping the second leg, said first and second legs being joined together by a circular segment to form a U-shaped grip.

2. The handle according to claim 1, wherein the first leg is greater in length than the second leg.

3. The handle according to claim 1, wherein the handle is adapted for fastening on distally opposing sides of an axis perpendicular to at least one leg of the handle.

4. The handle according to claim 1, wherein the handle further comprises a plastic-coated metal core.

5. The handle according to claim 1, wherein the handle is adapted for stabilizing the first and second surfaces.

6. The handle according to claim 1, wherein the handle further comprises:

a first gripping region proximate the first leg;

a second gripping region adjacent to and overlapping with a third gripping region, the second and third gripping regions proximate the circular segment; and a fourth gripping region proximate the second leg.

7. The handle according to claim 1, wherein the first leg is angularly attached to the first surface of the door at an angle of 10° to 30° relative to a first axis approximately axial the first leg.

8. The handle according to claim 1, wherein the second leg is angularly attached to the second surface of the door at an angle of 20° to 40° relative to a second axis approximately axial the second leg.

9. The handle according to claim 1, wherein the circular segment includes a quarter-circle segment.

10. The handle according to claim 1, wherein the first surface includes a front side of the door and the second surface includes one of a right side and a left side of the door.

11. A handle for a raisable door of a dishwasher, fastened in a corner region of a door, wherein the handle comprises:

a first leg having a first end angularly attached to a first surface of the door, the first leg having at least a first portion spaced from the first surface to permit fingers of a hand to fit between the first portion and the first surface when gripping the first leg; and a second leg having a second end angularly attached to a second surface of the door, the second leg having at least a second portion spaced from the second surface to permit the fingers of the hand to fit between the second portion and the second surface when gripping the second leg, said first and second legs being joined together to form a U-shaped grip, wherein the first leg and the second leg extend from the first surface and the second surface that extend beyond the corner region.

* * * * *